US007404455B2

(12) United States Patent
Yue et al.

(10) Patent No.: US 7,404,455 B2
(45) Date of Patent: Jul. 29, 2008

(54) AUTOMATIC SPT MONITOR

(75) Inventors: Zhong Qi Yue, Hong Kong (HK); Chack Fan Lee, Hong Kong (HK); Peter Kai Kwong Lee, Pokfulam (HK); Leslie George Tham, Hong Kong (HK)

(73) Assignee: The University of Hong Kong, Hong Kong (CN)

( * ) Notice: Subject to any disclaimer, the term of this patent is extended or adjusted under 35 U.S.C. 154(b) by 148 days.

(21) Appl. No.: 11/302,048

(22) Filed: Dec. 13, 2005

(65) Prior Publication Data

US 2007/0131453 A1 Jun. 14, 2007

(51) Int. Cl.
*E21B 47/12* (2006.01)
*E21B 19/00* (2006.01)

(52) U.S. Cl. ..... 175/27; 175/40; 175/20; 175/135; 175/44; 173/4

(58) Field of Classification Search ..... 175/40, 175/20, 135; 173/2, 4, 11, 152
See application file for complete search history.

(56) References Cited

U.S. PATENT DOCUMENTS

| | | | | |
|---|---|---|---|---|
| 6,105,690 | A * | 8/2000 | Biglin et al. | 175/48 |
| 6,286,613 | B1 * | 9/2001 | Tsai et al. | 175/20 |
| 6,637,523 | B2 | 10/2003 | Lee et al. | |
| 6,966,950 | B2 * | 11/2005 | Winiewicz et al. | 118/712 |
| 2002/0043404 | A1 * | 4/2002 | Trueman et al. | 175/45 |
| 2005/0194134 | A1 * | 9/2005 | McGregor et al. | 166/264 |

OTHER PUBLICATIONS

American Society on Testing and Materials (ASTM), "Standard Test Method for Penetration Test and Split-Barrel Sampling of Soils," 1995, 129-133, Designation: D-1586-84.
ASTM, "Standard Test Method for Stress Wave Energy Measurement for Dynamic Penetrometer Testing Systems," Soil and Rock(I), 1995, 775-778, Designation: D4633-86.
Geotechnical Engineering Office, "Standard Penetration Tests," Guide to Site Investigation, 1997, 111-113, Ch. 21.

(Continued)

*Primary Examiner*—William Neuder
*Assistant Examiner*—Sean Andrish
(74) *Attorney, Agent, or Firm*—Robert D. Katz; Cooper & Dunham LLP

(57) ABSTRACT

An apparatus is used with an impact hammer penetration assemble such as standard penetration test (SPT) in geotechnical engineering. The impact hammer penetration assembly comprises a penetration sample, a series of rods coupled together and an impact hammer apparatus. The drop of the hammer from a constant height hits the coupled rods and sampler in series and forces the sampler deeper into the ground. The apparatus includes a tip depth transducer and sampler to output a first electrical signal that is a function of the sampler tip position. A shock force transducer communicates the axial shock force in the rod to output a second electrical signal that is a function of the rod shock force and hammer blows. A shock penetration transducer communicates the movement of the coupled rods and sampler to output a third electrical signal that is a function of the sampler penetration due to the hammer blows. A micro-process controller monitors and processes the first, second and third signals in real time.

12 Claims, 12 Drawing Sheets

OTHER PUBLICATIONS

Hong Kong Housing Authority, "Standard Penetration Tests," General Specifications for Ground Investigation Contracts, 2003, 1-1—1-2.

Yue, Z.Q., et al., "Automatic Monitoring of Rotary-Percussive Drilling for Ground Characterization . . . ," International Journal of Rock Mechanics & Mining Science, 2004, 573-612.

* cited by examiner

DATE
29-06-2005

BEGINNING TIME
3:21 PM

ENDING TIME
3:23 PM

| SEATING DRIVE | MAIN DRIVE | | | | |
|---|---|---|---|---|---|
| BLOWS | N75 | N150 | N225 | N300 | BLOWS |
| 4 | 3 | 5 | 6 | 9 | 23 |
| PENETRATION (mm) | S75(mm) | S150(mm) | S225(mm) | S300(mm) | PENETRATION (mm) |
| 150 | 75 | 75 | 75 | 75 | 300 |

| SPT SUMMARY | TOTAL BLOWS | TOTAL PENETRATION (mm) |
|---|---|---|
| N=23 | 27 | 454 |

AUTOMATIC SPT MONITOR

FIELD OF THE INVENTION

This invention relates to improved methods for subsurface exploration, and more particularly to an automated apparatus and methods for performing the standard penetration test.

BACKGROUND OF THE INVENTION

The Standard Penetration Test (SPT) is an in-situ testing technique that drives a sampler into the ground at the bottom end of a drill hole (or borehole) during subsurface exploration. The test can yield a measure of the soil resistance to the penetration of the sampler under the impact of a free drop hammer from a constant height.

There are two operators to conduct the test operations. As shown in FIGS. 1 and 2, the primary operator uses the power of the drilling rig and the steel wireline above the derrick to lift or drop the hoist hook. The secondary operator couples or decouples the hoist hook either with the top of a drill rod (FIG. 1) or with the steel chain of a impact hammer apparatus (FIG. 2). The impact hammer apparatus includes the steel chain, a X-clamp, the hammer and the guide rod. The guide rod has a lower anvil at its bottom, an upper anvil at its top, and a steel chain. The hammer has a cap for clamping by the X-clamp. The testing at a drill hole depth follows the following three processes in a real time sequence.

At first, the sampler coupled to a drill rod in series has to be inserted into the drill hole (FIG. 1). The sampler has to reach the bottom of the drill hole. If the length of the drill rod whose bottom end is coupled with the sampler cannot make the sampler tip to reach the bottom of the drill hole, a second drill rod will be added to the top of the first drill rod to make the sampler tip to reach the drill hole bottom. Similarly, a third drill rod will be added and coupled if the sampler tip still cannot reach the drill hole bottom. This adding, coupling and inserting process will be repeated until the sampler tip reaches the drill hole bottom. This process is the first process of sampler inserting.

Next, once the sampler is placed at the test depth, the impact hammer apparatus will be added to the top of the coupled drill rods and the sampler system. The hammer impact apparatus will be used to make the sampler penetrate into the ground at the drill hole bottom (FIG. 2). The hoist hook will lift the X-clamp upward through the steel chain. The X-clamp will clamp the hammer cap and carry the hammer upward along the guide rod. Once the X-clamp impacts the upper anvil, the clamping at the hammer cap will be forced to open and release the hammer automatically. The hammer will drop freely along the guide rod. The flat bottom surface of the hammer will hit the lower anvil at its flat top surface. The lower anvil bottom is coupled to the drill rods. The induced shock force in the drill rods will make the sampler penetrate into the ground below the drill hole bottom. Once the hammer becomes stable on the lower anvil, the primary operator will drop the hoist hook to make the X-clamp drop onto the hammer cap along the guide rod. Then the operator will tighten the steel chain to make the X-clamp couple the hammer cap again. The operator will then lift the hammer quickly. Again, the hammer will drop freely once the X-clamp impacts the upper anvil. The hammer will hit the lower anvil to make the sampler to penetrate the soil again. The above operation process will be repeated several times until a test criterion is satisfied. This process is the second process of hammer impact and sampler penetrating.

Third, once the penetrating stage is completed, the operators will remove the hammer impact apparatus from the drill rods. The operators will then retrieve the drill rods from the drill hole one by one (FIG. 1). The drill rods and the sampler will be lifted up. The top drill rod will then be decoupled from the remaining drill rods in the drill hole, and it will be placed on the ground nearby. Then the remaining drill rods will be removed from the drill hole. The second top drill rod will be decoupled and placed on the ground nearby. This lifting, decoupling and placing process will be repeated until the first drill rod with the sampler is retrieved from the drill hole. This process is the third process of sampler retrieving. Further drilling work will be then carried out until the bottom end of the drill hole reaches the subsequent test depth. Then the subsequent test will be conducted following the above three processes.

The hammer is made of steel and weighs 63.5 kg. The free drop height is 760 mm. The blow counts of the hammer falling on the anvil are recorded for each of 75 mm penetration between 0 and 450 mm penetrations. The first 150 mm penetration is regarded as a seating drive. The number of blows necessary to drive the sampler to penetrate 300 mm into the ground is known as the penetration resistance or N-value. A specification on how to determine the N-value is normally adopted by authorities for determining the soil shear strength and bearing capacity. A hammer efficiency can be further defined as the percentage ratio of a rod dynamic energy over the total potential energy of the hammer drop height (473 Joule). The rod dynamic energy is calculated from the axial shock force in the drill rod generated by the hammer blowing according to a specific equation such as the equation in ASTM (1995).

The SPT has been widely used and is a tool of choice in Hong Kong housing and infrastructure development as well as landslip preventive measures project. The SPT is included for most ground investigation contracts. The SPT has the following advantages: a) the test apparatus is simple and rugged; b) the test can be carried out in many different types of soils; c) the test has been widely adopted as a routine in-situ testing method throughout the world; and d) tremendous experience and empirical correlations have been obtained for geotechnical design and construction.

The SPT results, and more particularly the N-value and the test depth, however, have been obtained completely from manual measurements. Usually, two contractors conduct the manual measurements. For most tests, there is no full-time independent supervision or inspection. Furthermore, the testing and the drilling are destructive, non-repeatable and time consuming. More importantly, the test is often carried out in colluvium and weathered rock soils in Hong Kong. Gravel, cobbles, and boulders of high strengths and stiffness can appear randomly in the soil. They can substantially alternate the N-values. As a result, the N-values at a construction site can have a large range of variations in Hong Kong.

Therefore, the accuracy and quality of the manual test results have always been the main concern of many geotechnical engineers and contractors in Hong Kong. At present, there is no tool independently to check and verify the accuracy and quality of the manual test results. Therefore, it is believed that automation of the measurement monitoring and recording for SPT can solve the pressing issues and offer additional data for independently checking and verification of the manual test results.

SUMMARY OF THE INVENTION

The field observation and issue of the manual operations and measurements of the conventional standard penetration test have led to the present invention for automation of the test measurements. The inserting process, the impact hammer and sampler penetrating process, and retrieval process are carried out sequentially in time sequence. A first object of the present invention is to provide an automatic digital SPT monitor for recording and evaluating the inserting process of the rods and sampler into a drill hole in real time, which enables the assessment and verification of the test depth and its commencement time. A second object of the present invention is to provide an automatic digital SPT monitor for recording and evaluating the impact hammer and sampler penetration process in real time, which is able to assess the soil resistance and more particularly the N-value and the associated hammer efficiency in accordance with a specification [in the present configuration, the specification is the Hong Kong Housing Authority specification]. A third object of the present invention is to provide an automatic digital SPT monitor for recording and evaluating the retrieval process of the rods and sampler from a drill hole in real time, which enables the assessment and verification of the test depth and its completion time.

In order to accomplish the foregoing objects, the present invention provides an in situ digital SPT monitor for the standard penetration tests in association with an existing SPT apparatus and operation procedures. The digital SPT monitor comprises a tip depth transducer, a shock force transducer, a shock penetration transducer, and a micro-process controller for data acquisition and processing. The micro-process controller comprises a notebook computer, a data logger, and a battery. The data logger connects with the tip depth transducer, the shock force transducer and the shock penetration transducer with a first signal cable, a second signal cable and a third signal cable for transmission of a first electrical signal, a second electrical signal and a third electrical signal, respectively. The first and third electrical signals are digital signals. The second electrical signal is an analog signal.

Immediately before the commencement of the insertion process, the tip depth transducer is mounted onto the top of a drill hole casing and unlocked. The tip depth transducer senses the vertical movement (or non-movement) of the sampler and each of the coupled drill rods with respect to a fixed position (i.e., the casing) on the ground during the insertion process, and transmits the first electrical signal into the micro-process controller for storage and display at a first pre-selected sampling rate in real time. At the completion of the insertion process, the tip depth transducer is locked and dismounted from the casing and placed on the ground nearby. The lock makes the first electrical signal have no change with time.

Subsequently, the impact hammer apparatus together with the shock force transducer and the shock penetration transducer are mounted onto the top of the drill rod in series for the second process of impact hammer and sampler penetration. The shock force transducer senses the axial force in the rod and the shock penetration transducer senses the rod displacement with respect to a fixed position on the ground. They transmit the second and the third electrical signals to the micro-processor controller with the second and the third electric cables simultaneously and in real time. A triggering method is adopted for data acquisition and storage for a pre-selected duration of time in the micro-processor controller at a second pre-selected sampling rate. The criterion for triggering is that the shock force is equal or greater than a pre-selected magnitude in compression. The pre-selected interval of data acquisition is less than the time interval for hammer lifting and drop and is greater than the time interval for hammer rebound. At the same time, the micro-process controller counts and records one hammer blow. This auto-monitoring and data acquisition process is repeated for each hammer blow until the micro-processor controller finds that the test has reached one of the predetermined criteria for the N-value. At this moment, the computer of the micro-process controller alerts the operators. After the completion of the second process, the impact hammer apparatus, the shock force transducer, and the shock penetration transducer are removed from the drill rod.

At the beginning of the retrieval process, the tip depth transducer is re-mounted onto the casing and unlocked. The tip depth transducer senses the vertical movement or non-movement of the sampler and each of the coupled drill rods with respect to a fixed position (i.e., the casing) on the ground during the retrieval process and continues the transmission of the first electrical signal into the micro-process controller for storage and display at the first pre-selected sampling rate in real time. At the completion of the retrieval process, the tip depth transducer is again locked and dismounted from the casing and placed on the ground nearby.

In the present configuration, the pre-selected first sampling rate is 100 Hz for the first electrical signal and 50 kHz for the second and third electrical signals; the pre-selected magnitude of the triggering axial force is 50 kN; and the pre-selected duration of data acquisition for the second and third electrical signals is one second.

The present invention is portable and is applicable to any existing SPT apparatus. It monitors the three testing processes in real time. It further evaluates the SPT measurements and reports a summary of the test results from the monitored digital data in real time sequence. It is applicable to various ground conditions including extreme hard ($N>200$), normal ($1<N<200$) and extreme soft (e.g., $N<1$) ground conditions at any test depths.

BRIEF DESCRIPTION OF DRAWINGS

The foregoing and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
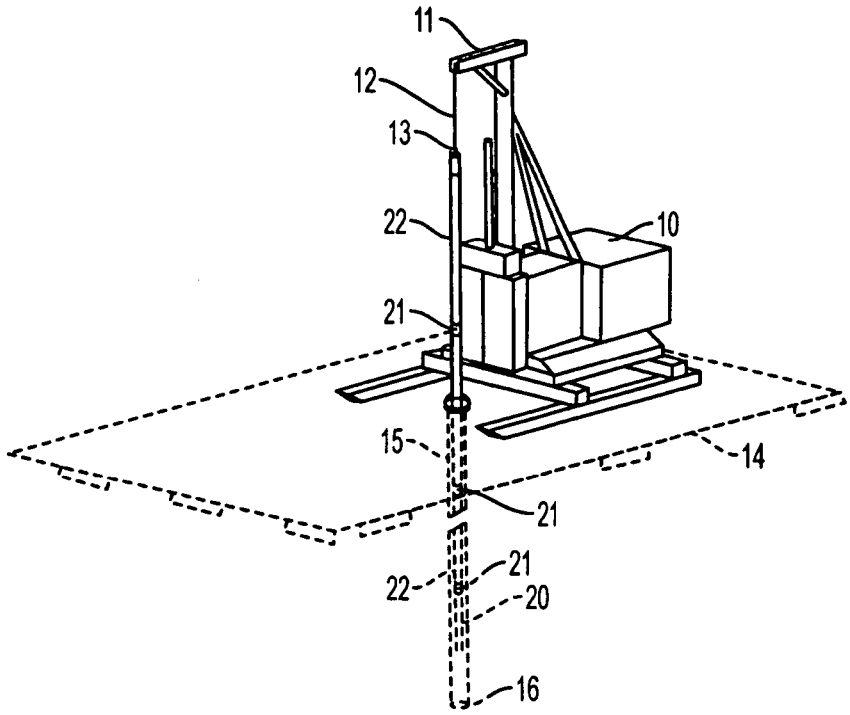
FIG. 1 PRIOR ART
FIG. 1 is a prior art manual apparatus for the first process of inserting (or the third process of retrieving) a sample coupled with drill rods in series into and from a drill hole for SPT at a given test depth at field.
Figure 2:
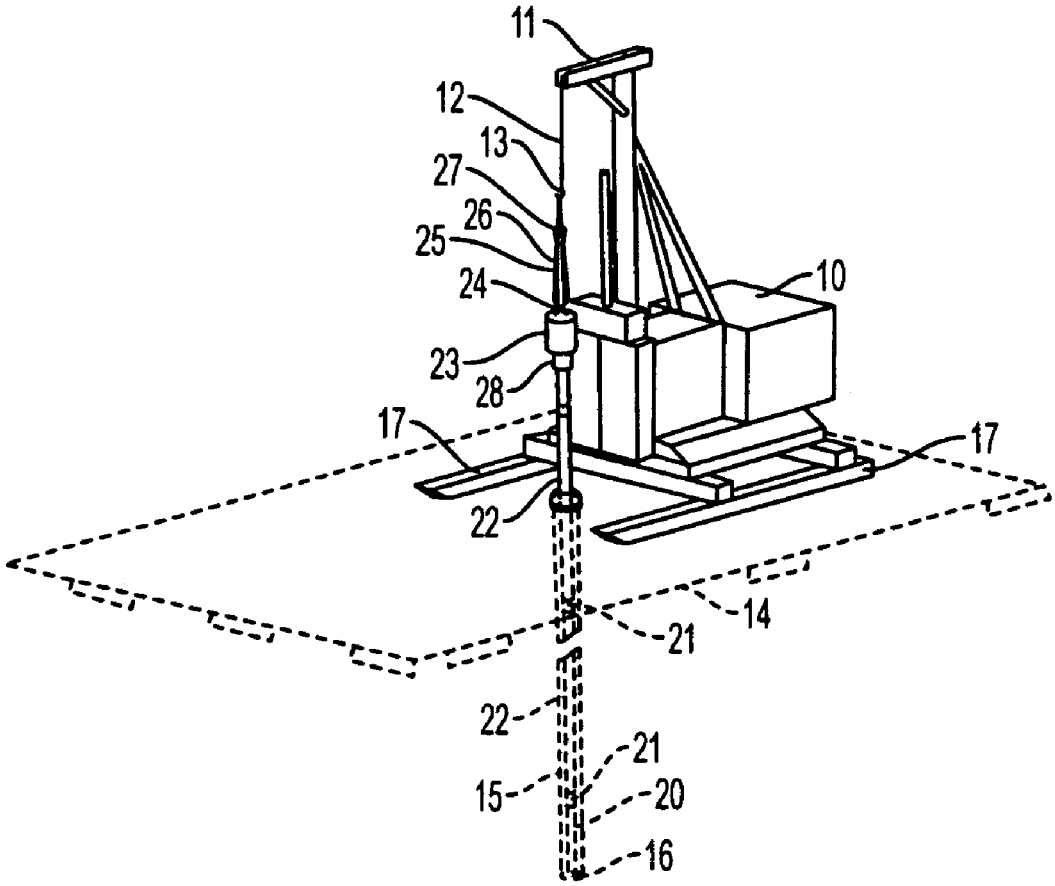
FIG. 2 PRIOR ART
FIG. 2 is a prior art apparatus for hammer and sampler penetrating at the bottom of a drill hole to determine the soil N value at field.
Figure 3:
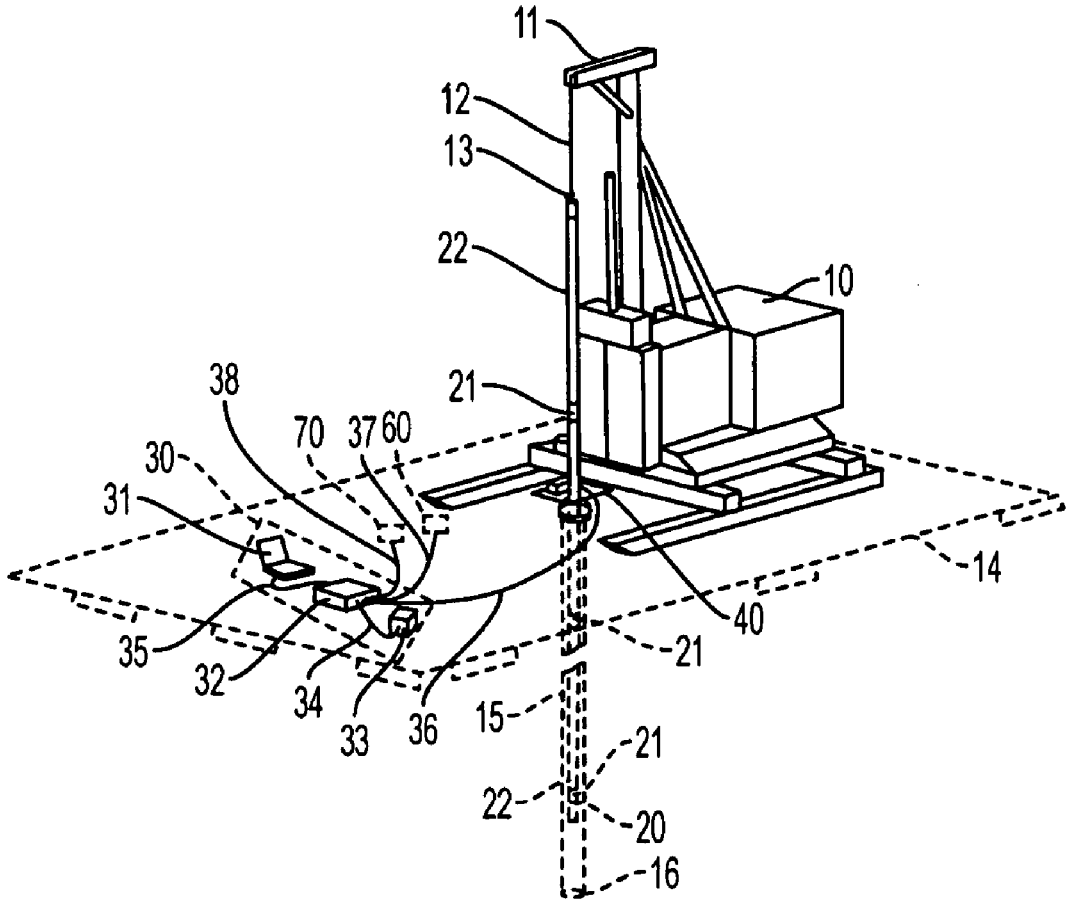
FIG. 3 is a general schematic view of the measurement, automation, and recording of the first process of the sampler insertion or the third process of the sample retrieval of the prevent invention.

The present invention will be described in further detail by way of example with reference to the accompanying drawings. As shown in FIGS. 3 to 8, a digital SPT monitor 10 for measurement automation of standard penetration test according to the present invention comprises a micro-process controller 30, a tip depth transducer 40, a shock force transducer 60, and a shock penetration transducer 70. The micro-process controller 30 comprises a data logger 32, a battery 33, and a notebook computer 31. The data logger 32 uses a power supply cable 34 to attach the battery 33 and uses a firewall cable 35 to communicate with the computer 31. The battery 33 is used to supply the small amount of power required for the data logger 32 and the notebook computer 31. The micro-process controller 30 further uses the first signal cable 36 to communicate with the tip depth transducer 40, the second signal cable 37 to communicate with the shock force transducer 50, and the third signal cable 38 with the shock penetration transducer 60.

Figure 5:
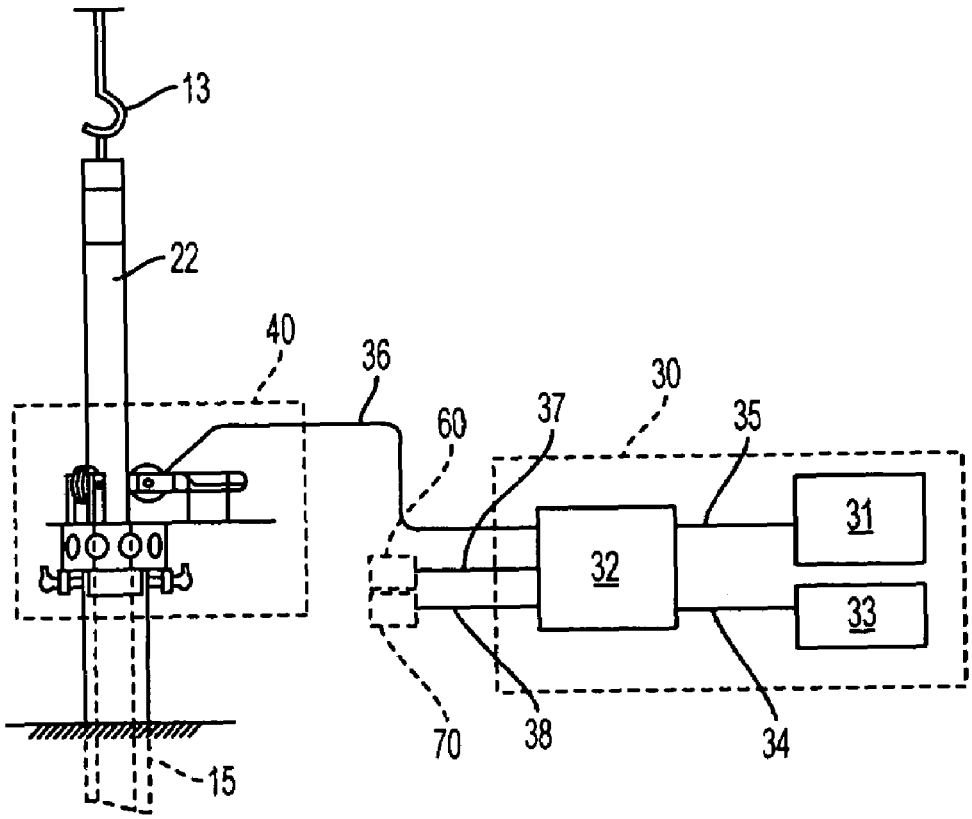
FIG. 5 is a detailed schematic view of the present invention for measurement, automation, and recording of the first process of the sampler insertion or the third process of the sample retrieval.
Figure 6:
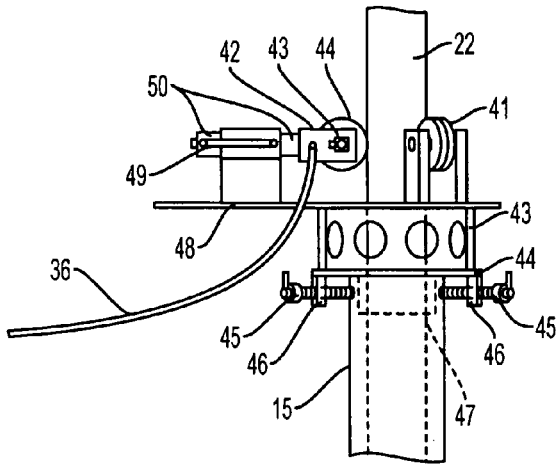
FIG. 6 is a detailed schematic view of the tip depth transducer of the present invention.

Referring to FIGS. 5 and 6, the tip depth transducer 40 has the following components: a first circular wheel 41 with a first rotation sensor 42 and a lock, a second circular wheel 41 and a third circular wheel 44, a hollow cylinder 43, a footing plate 44 with a circular hole at the center, four screw blots 45, four columns 46, an inner cylinder 47, a podium plate 48 with a circular hole, two springs 49, and a travel shaft 50. The first wheel 41, the second wheel 41 and the third wheel 44 are vertically placed above the podium plate 48 and surround a common center at a spacing of 120° on horizontal plane. The footing of the travel shaft 50 is also welded on the podium plate 48. The podium plate 48 has its bottom surface welded with the hollow cylinder 43 below. The hollow cylinder 43 has its base welded with the footing plate 44. The footing plate 44 is welded above and with the inner cylinder 47 and the four columns 46. The diameters of the circular holes in the podium plate and the footing plate are larger than the diameters of the drill rod 22 and sampler. The inner diameter of the hollow cylinder 43 is larger than the diameter of the casing. The inner diameter of the inner cylinder 47 is larger than the diameters of the drill rod and sampler and less than the diameter of the casing.

The tip depth transducer 40 uses the footing plate 44 to seat on the casing and the four screw bolts 45 to clamp the four columns onto the casing. Therefore, the tip depth transducer 40 can be firmly mounted onto or completely removed from the top of a casing in a drill hole. The coupled sampler and drill rods can be inserted into or retrieved from the tip depth transducer 40 as shown in FIGS. 5 and 6. In the present configuration, the casing is used to support the tip depth transducer. Other means to support the tip depth transducer 40 can also be developed.

During insertion or retrieval, the sampler or a drill rod 22 frictionally contacts with the three wheels and causes them to rotate about their rotational axes. The rotational axis of the first wheel 42 is bolted to the travel shaft 50. The first wheel 42 and the travel shaft 50 together can move horizontally above the podium plate. The two springs 49 urge the travel shaft and the first wheel against the drill rod 22 or the sample. When it is switched off, the lock stops the rotation of the first wheel 42 about its axis. When it is switched on, the first wheel can freely rotate about its axis.

The first electrical signal measures the degree of the rotation of the first wheel 42 about its axis. The first rotation sensor 42 captures the first electrical signal and transfers it into the micro-process controller through the first signal cable 36 in real time at a first pre-selected sampling frequency. The micro-process controller 30 further changes the first electrical signal into the amount of the length of the sampler coupled with the rods passing through the first wheel position in real time and displays it on the screen of the notebook.

Figure 7:
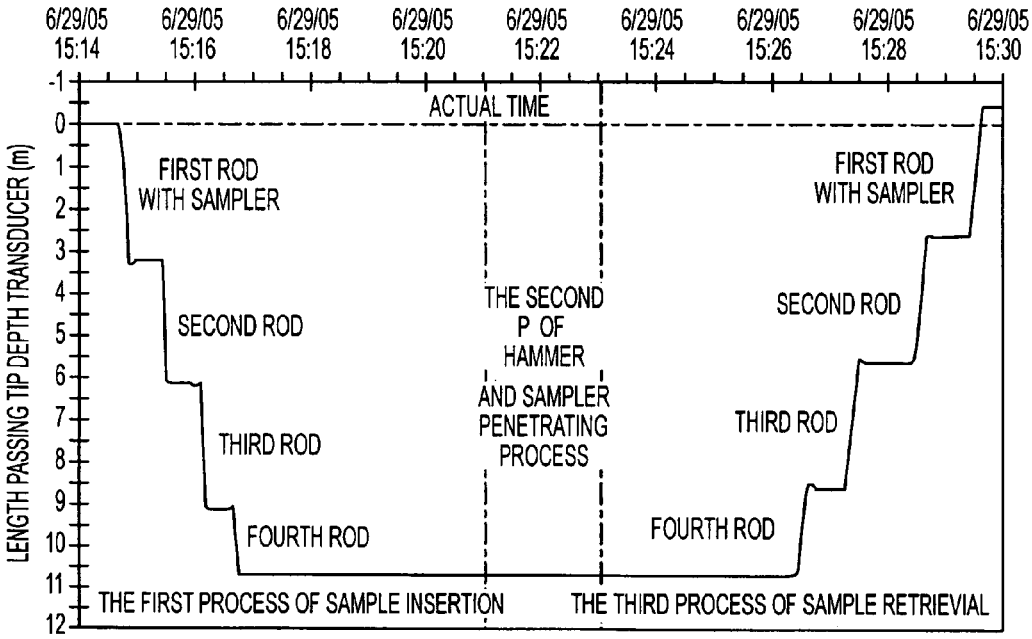
FIG. 7 is an example of actual measurement results of the present invention from the tip depth transducer for the first process of sample insertion and the third process of sample retrieval in real time series.

FIG. 7 shows the first graph for an actual result of the present invention from the first digital signal, where the first pre-selected sampling frequency was 100 Hz. The first graph represents the first process of sampler inserting and the third process of sampler retrieving. The test was carried out between 15:14 and 15:29 in the afternoon of Jun. 29, 2005. The first process was between 15:14 and 15:17. Its graph has a down-staircase shape with the actual time, representing that four rods were being coupled with the sampler for inserting the sampler into the drill hole one by one. The total length of the four rods and the sampler inserting through the tip depth transducer was 10.625 m. Between 15:17 and 15:25, the graph is a horizontal line, representing that the first electrical signal had no change during the second process, when the first wheel of the tip depth transducer was locked. The third process was between 15:25 and 15:29. Its graph has an up-staircase shape with the actual time, representing that the four rods and the sampler were being lifted up and decoupled out of the drill hole one by one. The total length of the four rods and the sampler lifting up through the tip depth transducer was 11.033 m.

Figure 4:
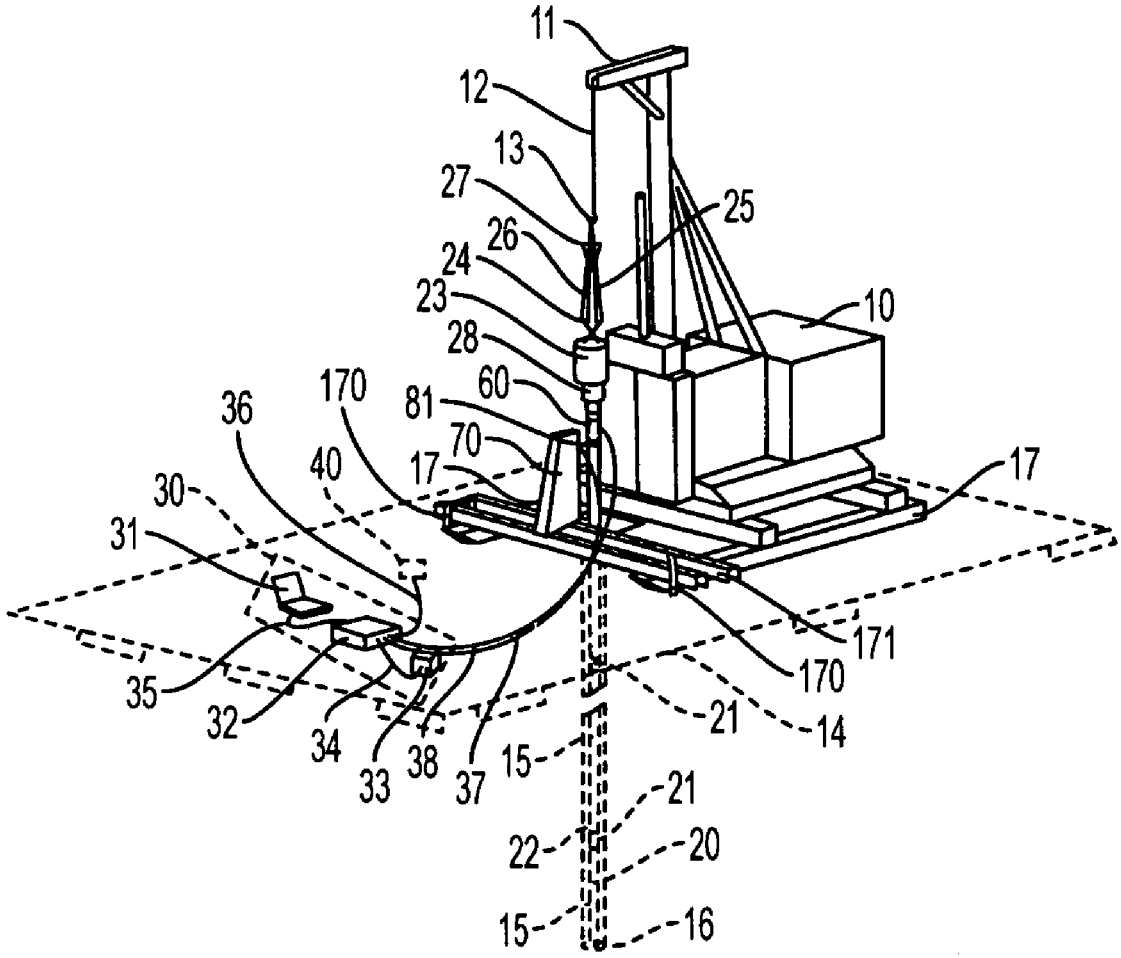
FIG. 4 is a general schematic view of the measurement, automation, and recording apparatus of the second process of the impact hammer and sample penetration in accordance with the present invention.
Figure 8:
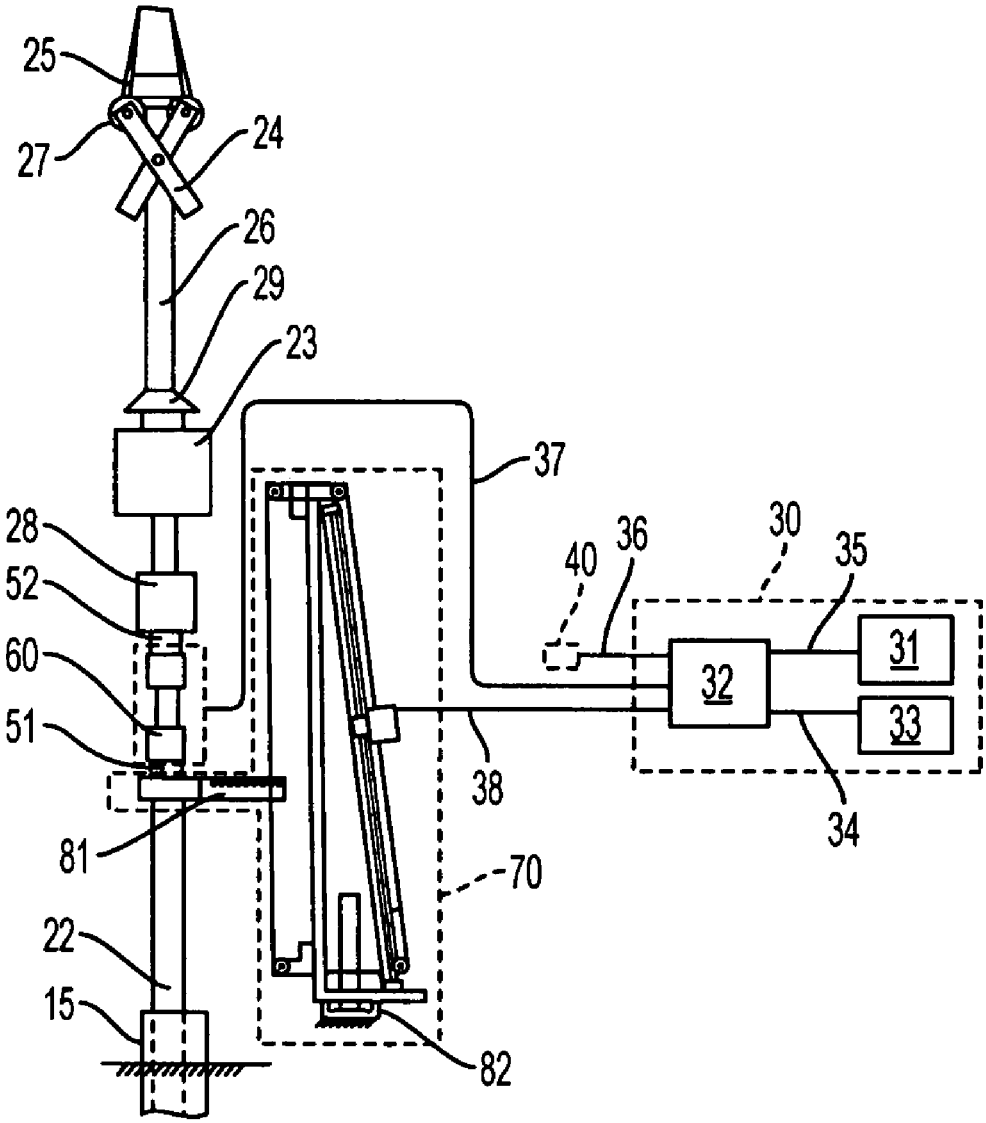
FIG. 8 is a detailed schematic view of the present invention for the measurement, automation, and recording of the second process of the impact hammer and sample penetration.

Referring to FIGS. 4 and 8, the shock force transducer 60 is connected to the lower anvil 28 with the upper coupling 52 and the drill rod 22 with the lower coupling 52 at the bearing arm 81. The shock force transducer 60 captures the second electrical signal and transfers it into the micro-process controller through the second signal cable 37 in real time at a second pre-selected sampling frequency. The second electrical signal is a voltage output. The micro-process controller 30 further changes the second electrical signal into the amount of the axial force due to the hammer impact in the drill rod 22 and displays it on the screen of the personal computer 31 in real time.

Figure 9:
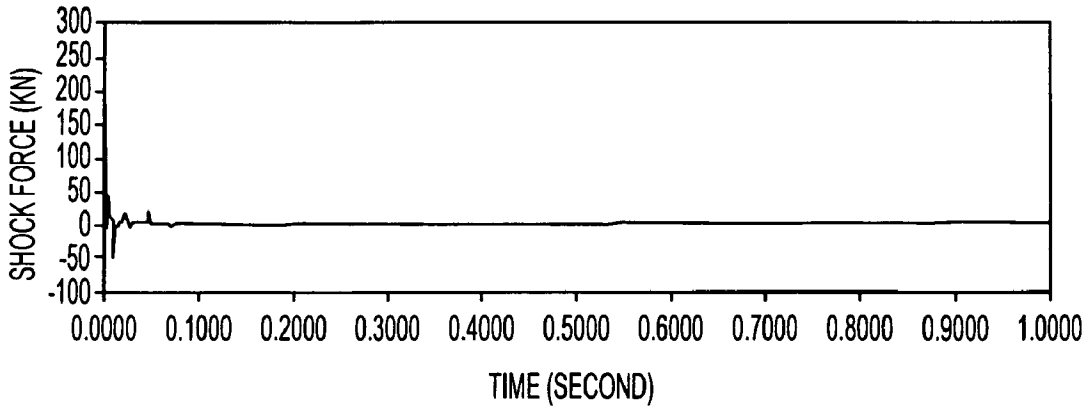
FIG. 9 is the axial shock force measurement with the shock force transducer in the drill rod for one second due to the impact of hammer drop at field.
Figure 10:
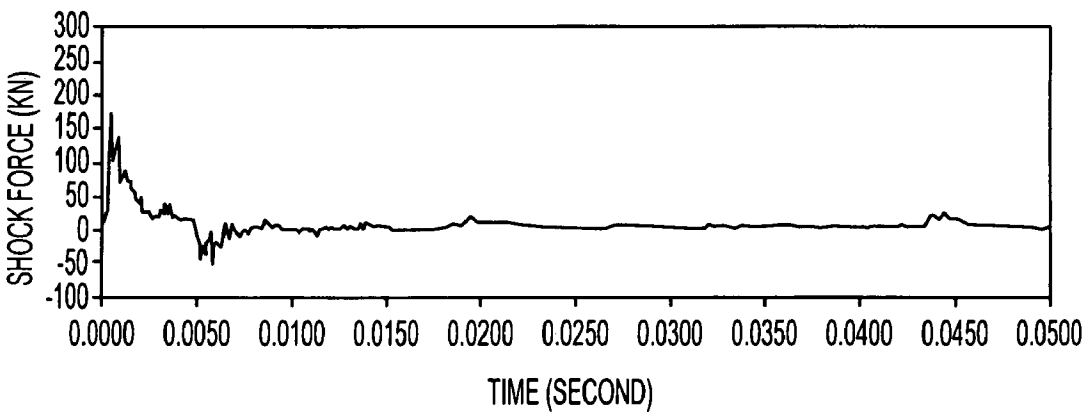
FIG. 10 is a detailed view of the result of the shock force in FIG. 9 during its initial 0.05 second duration.

FIG. 9 shows the second graph for an actual result of the present invention from the second digital signal, where the second pre-selected sampling frequency was 50 kHz and the total sampling period was one second. The second graph represents the time variation of the shock force in the drill rod immediately after the hammer impact on the lower anvil. A third graph in FIG. 10 details the axial shock force within the first 0.05 second of the second graph in FIG. 9. From the second and third graphs in FIGS. 9 and 10, the following observations can be made: (a) the axial shock force increased quickly at the beginning and reached its maximum at a time less than 0.001 second; (b) the axial shock force vanished to zero at about 0.05 second; and (c) the axial shock force had the maximum value about 230 kN.

Figure 11:
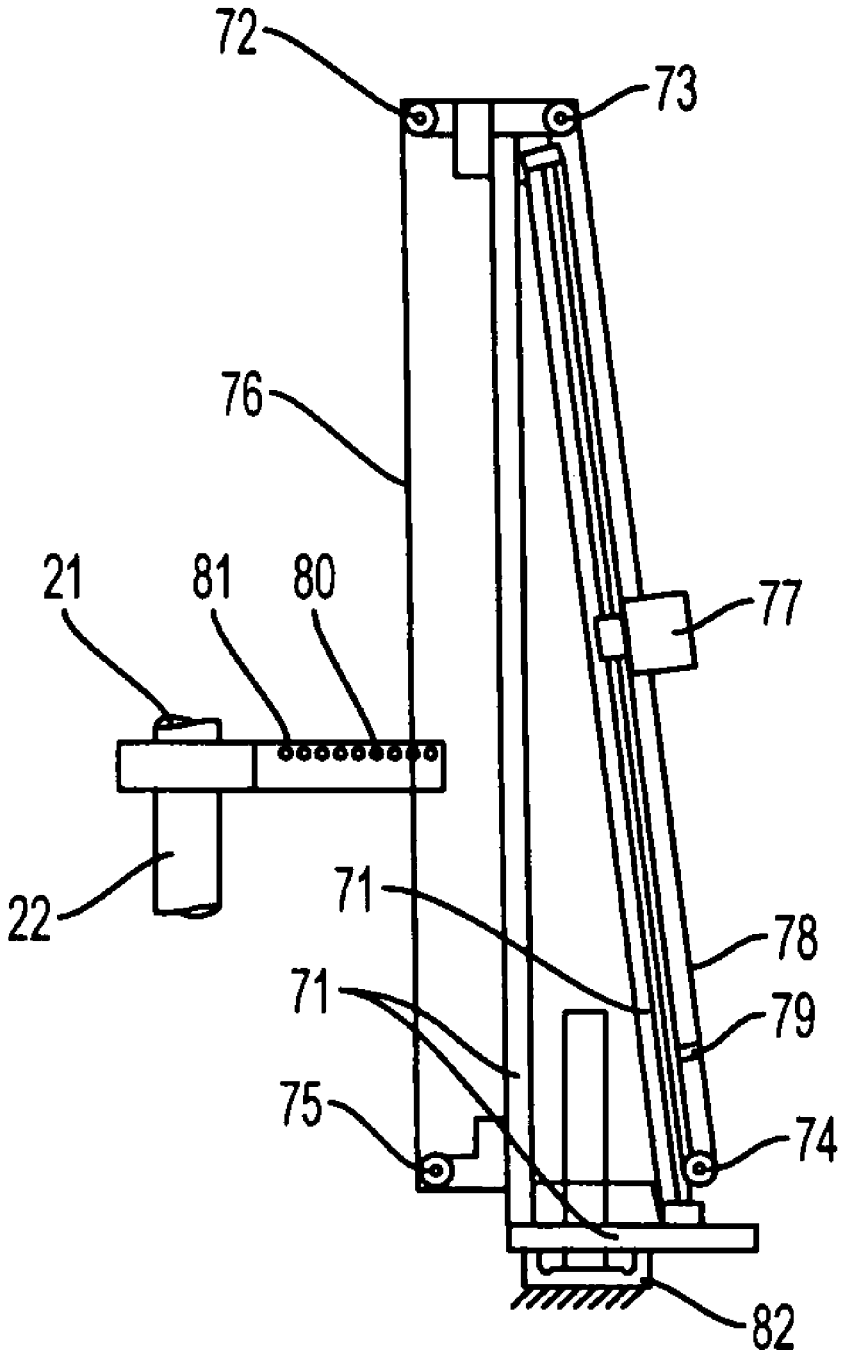
FIG. 11 is a detailed schematic view of the shock penetration transducer of the present invention.
Figure 12:
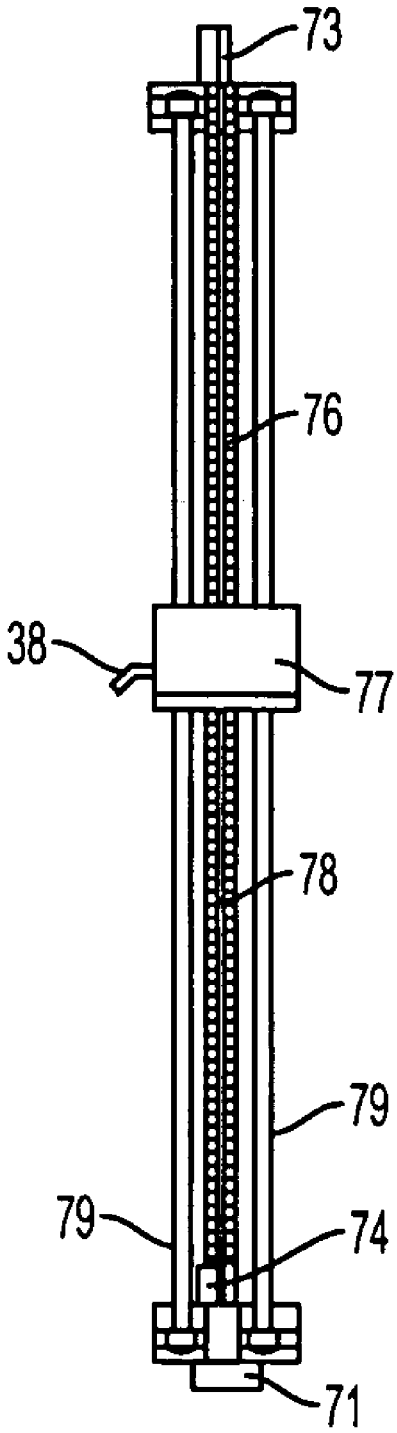
FIG. 12 is a detailed schematic view of the gear box on the rack and along the two guide rods of the shock penetration transducer of the present invention.

Referring to FIGS. 8, 11 and 12, the shock penetration transducer 70 has the following main components: a right triangle steel frame 71 with four pulleys 72, 73, 74, and 75, a steel wire loop 76, a gear box with a second rotation sensor 77, an inclined rack 78, two inclined guide rods 79, a bearing arm 80 and other accessories. During monitoring, the shock penetration transducer 60 is coupled to the drill rod 22 with the bearing portion of the bearing arm 81, as shown in FIGS. 8 and 11. The shock penetration transducer 60 rests on a supporting beam 82 clamped on the two sleepers of the drilling rig, as shown in FIG. 4.

The bearing arm 81 is tied to the steel loop wire 76 with a bolt 80 and transfers the rod's longitudinal movement to the steel loop wire 76. The steel loop wire 76 is supported by the first pulley 72, the second pulley 73, the third pulley 74 and the fourth pulley 75, and can smoothly slide on the four pulleys. The four pulleys are supported by the right triangle steel frame 71. The steel loop wire 76 is also connected with the gear box 77 on the inclined rack 78. The gear of the gear box 72 matches the rack gear. The two steel guide rods 79 guide the upward or downward movement of the gear box 77 on the rack 78. The rack 78 and the two steel guide rods 79 are fixed with the right triangle steel frame 71.

As it moves between the first pulley 72 and the fourth pulley 75, the bearing arm 81 uses the steel loop wire 76 to bring the gear box 77 to slide correspondingly on the rack between the second pulley 73 and the third pulley 74. The upper portion of the steel loop wire 76 on the first 72 and second 73 pulleys between the bearing arm 81 and the gear box 77 is always straight and in tension because it prevents the gear box 77 from sliding down on the rack 78 due to the weight of the gear box 77. The gear box 77 typically weighs one to two kilograms. The lower portion of the steel loop wire 76 on the third pulley 74 and the fourth pulley 75 and between the gear box 77 and the bearing arm 81 is used to quickly damp and eliminate the free vibration of the gear box 77 on the rack 78 from the impact of the hammer.

The second rotation sensor associated with the gear box 77 obtains the third electrical signal and transfers it into the micro-process controller 30 through the third signal cable 38 in real time at the second pre-selected sampling frequency. The third electrical signal is the degree of the rotation of the gear of the gear box 77 on the rack 78. The micro-process controller 30 further changes the third electrical signal into the position of the gear box on the rack and displays it on the screen of the notebook in real time. The gear box upward movement at its stable condition is equal to the permanent penetration of the sampler due to one blow from a hammer drop.

Figure 13:
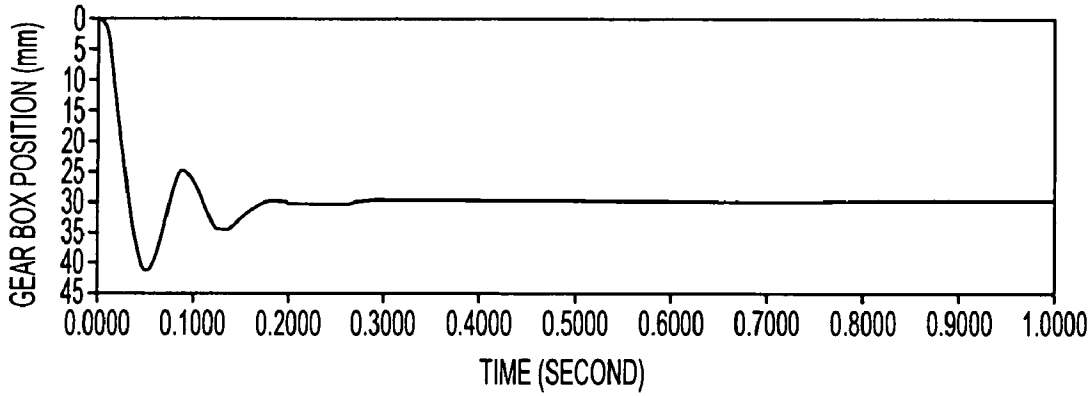
FIG. 13 is a graph of the shock penetration transducer for the change of the gear box position on the rack with the time simultaneous to that for the shock force in FIG. 9.
Figure 14:
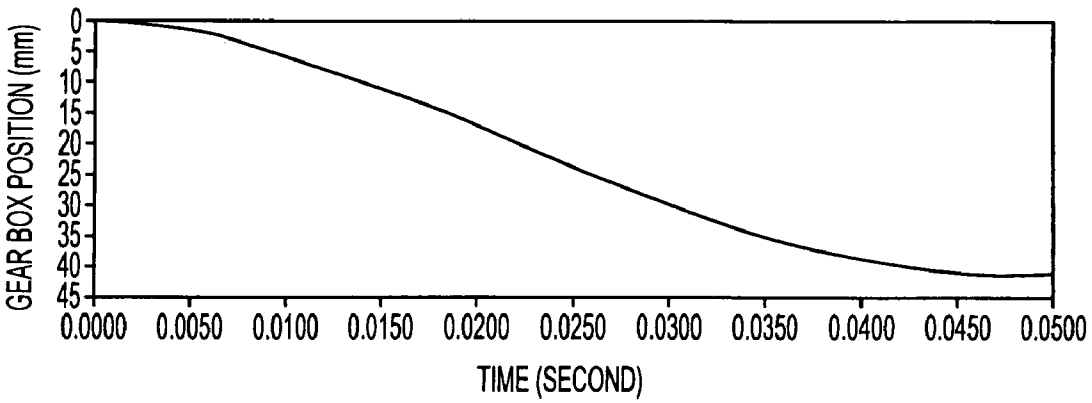
FIG. 14 is a detailed view of the typical result of the shock penetration transducer in FIG. 13 during its initial 0.05 second duration.

FIG. 13 shows the fourth graph for a typical result of the present invention from the third digital signal, where the second pre-selected sampling frequency was 50 kHz and the total sampling period was one second. This fourth graph represents the time variation of the gear box position on the rack immediately after the hammer blow onto the lower anvil. A fifth graph in FIG. 14 details the gear box position within the first 0.05 second of the fourth graph in FIG. 13. From the fourth graph in FIG. 13 and the fifth graph in FIG. 14, the following observations can be made: (i) the change of the gear box position due to the hammer blow vanished within 0.2 second; (ii) initially, the gear box monotonically moved upward to a maximum at a time between 0.045 and 0.005 second; (iii) subsequently, the gear box had its first downward movement; (iv) then, the gear box experienced small vibrations with magnitude less than 2 mm; and (v) after about 0.2 second, the gear box position had no change with time and stayed at a position 22 mm above the initial position.

The time in the second graph in FIG. 9 was exactly the same at that in the fourth graph in FIG. 13. The time in the third graph in FIG. 10 was exactly the same at that in the fifth graph in FIG. 14. The micro-process controller 30 collected the second and third electrical signals simultaneously at the second pre-selected time-sampling frequency in real-time sequence. The micro-process controller 30 also recorded the actual commencement time (i.e., the time 0) of the graphs in FIGS. 9, 10, 13 and 14 in the form of year, date, hours, minutes and seconds, which are omitted in these figures.

Furthermore, the micro-process controller 30 of the present invention has a triggering mechanism for data acquisition and storage of the second and third electrical signals in real time. The criterion for the triggering mechanism is that the shock force from the shock force transducer 60 is equal or greater than a pre-selected magnitude in compression (50 kN at the present configuration). Once the shock force reaches a pre-selected or predetermined the criterion, the micro-process controller 30 acquires, stores and displays the second and third signals at the second pre-selected sampling frequency (50 kN at the present configuration) for a pre-selected period of time (one second at the present configuration). At the same time, the micro-process controller 30 records one hammer blow and the actual commencement time of the data acquisition, and checks the accumulated permanent penetration and the accumulated hammer blow number with the predetermined specification for alerting the completion of the testing. This automonitoring and data acquisition process is repeated for each hammer blow until the micro-process controller 30 finds that the test has reached the pre-determined specification. At this point, the micro-process controller 30 alerts the operators of the completion of the testing.

Figure 15:
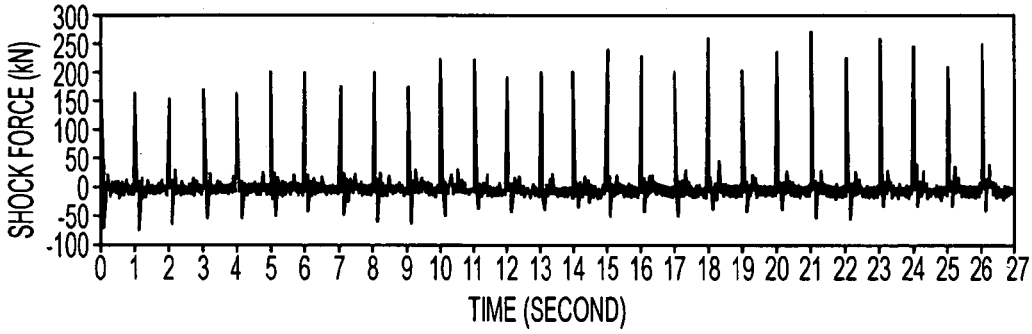
FIG. 15 is a summary report for the measurement automation of the second process of hammer blow and sample penetration at the test depth showing in FIG. 7.
Figure 15:
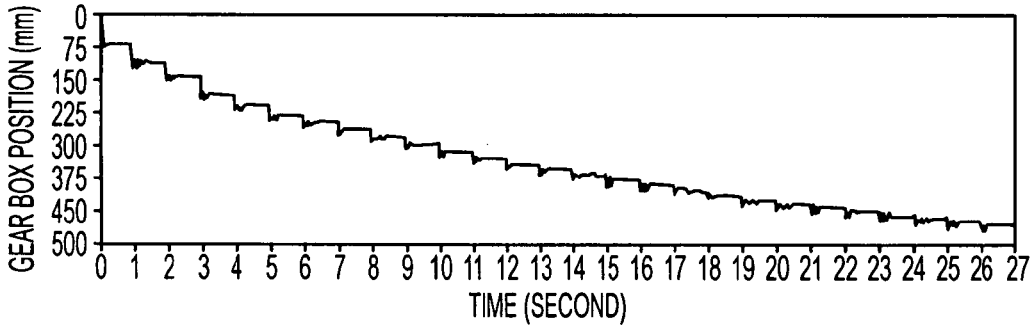
Figure 15:
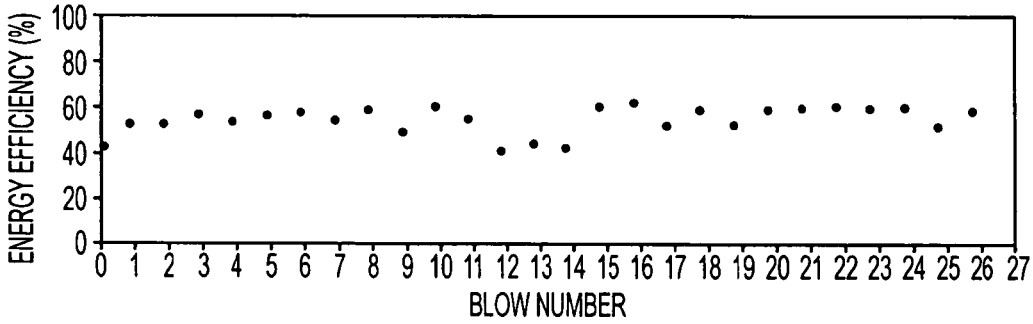

FIG. 15 shows a summary report of the present invention for the measurement automation of the second process of hammer blows and sampler penetration at the test depth showing in FIG. 7. The micro-process controller 30 produced and displayed this summary report once the test was completed. In FIG. 15, the actual date, the beginning and the ending time for the second process of the testing are reported. The numbers of the hammer blow for the 150 mm seating drive and each of the subsequent 75 mm main drives are shown in the table. The N value, the total blows and the total penetration depth are listed.

FIG. 15 also shows the sixth graph, the seventh graph and the eighth graph. The results shown in the sixth graph and the seventh graph were acquired simultaneously from the second electrical signal and the third electrical signal, respectively. The micro-process controller 30 was triggered 27 times for the data acquisition and evaluation at this test depth. Each triggering represents a hammer blow on the lower anvil in FIG. 4. The total time for the data acquisition is 27 seconds, which is the abscissa of the sixth and seventh graphs. Accordingly, there were 27 hammer blows in total in FIG. 15.

The actual commencement time of each of the one second sampling period was recorded but not shown in the sixth and seventh graphs. The portion of the sixth graph in FIG. 15 between any two nearby integers of the time seconds (say, [0,1], [1,2], . . . , [26,27]) represents the time variation of the axial shock force during the pre-selected sampling period of one second for each of the 27 hammer blows. Similarly, the portion of the seventh graph in FIG. 15 between any two nearby integers of the time seconds (say, [0,1], [1,2], . . . , [26,27]) represents the corresponding time variation of the gear box position during the pre-selected sampling period of one second for each of the 27 hammer blows. The time variation of the axial shock force during each of the 27 one-second data acquisition periods can be presented as those shown in the second and third graphs in FIGS. 9 and 10. The time variation of the corresponding gear box position during each of the 27 one second data acquisition periods can also be presented as those shown in the fourth and fifth graphs in FIGS. 13 and 14, respectively. All those graphs can be produced in the micro-process controller.

The micro-process controller also calculated the energy efficiency (%) from the acquired shock force in the sixth graph for each hammer blow, presented it in the eighth graph with respect to its corresponding blow number and displayed on the computer screen.

REFERENCES

The following references are incorporated by reference as illustrative of the state of the art.

1. ASTM, 1995. Soil and Rock (1), Vol. 04.08: *Standard Test Method for Penetration Test and Split-Barrel Sampling of Soils*, D 1586-84, 1916 Race Street, Philadelphia, U.S.A., 129-133
2. ASTM, 1995. Soil and Rock (1), Vol. 04.08: *Standard Test Method for Stress Wave Energy Measurement for Dynamic Penetrometer Testing Systems*, D 4633-86, 1916 Race Street, Philadelphia, U.S.A., 775-778.
3. GEO, 1996. Section 21.2 Standard Penetration Test, in *Guide to Site Investigation, Geoguide* 2, Geotechnical Engineering Office (GEO) Civil Engineering Department, Hong Kong, pp. 111-113.
4. HKHA, 2003. HKHA *General Specifications for Ground Investigation Contracts,* 2003 *Edition* (*Revision A*), Hong Kong Housing Authority (HKHA), Hong Kong. p. 2.
5. Yue, Z. Q., Lee, C. F., Law, K. T. and Tham, L. G., 2004. Automatic monitoring of rotary-percussive drilling for ground characterization—illustrated by a case example in Hong Kong, *International Journal of Rock Mechanics & Mining Science,* 41: 573-612.
6. U.S. Pat. No. 6,637,523 B2 (Lee)

We claim:

1. An apparatus for use with a penetration assembly for hammering a sampler into ground in a drill hole or born hole, the penetration assembly having; a sampler with a coupler at one end for connecting with a rod;

a number of rods, each end of the rod having a coupler for coupling the rods together in series; an impact hammer apparatus that can be connected or disconnected to the top end of a number of the coupled rods in series and can drop the hammer to impact the top end from a constant height;

a lifting device either for lifting the rod for coupling, decoupling, inserting and retrieving or for lifting the hammer to drop for hitting the top end of the coupled rods whose bottom end hammers the sampler repetitively; the apparatus comprising:

a tip depth transducer that outputs a first electrical signal that is a function of the total length of the sampler and the rods coupled together in series passing through the tip depth transducer at a fixed reference point on the top of a drill hole;

a shock force transducer that outputs a second electrical signal that is a function of the shock force in the rod and along the rod axial direction;

a shock penetration transducer that outputs a third electrical signal that is a function of the penetration depth of the sampler due to a blow from the impact hammer dropped from a constant height; and a controller that receives and monitors the first, second and third signals, and that produces respective graph traces of functions of the sampler tip position, the rod shock force, and the sampler shock penetration depth.

2. An apparatus as set forth in claim 1, wherein the controller monitors, processes, acquires and stores the first signal at a first pre-selected sampling frequency, and produces a first graph trace of position of the sampler tip depth.

3. An apparatus as set forth in claim 1, wherein the micro-process controller monitors and processes the second and third signals at a second pre-selected sampling frequency and uses the second signal as a triggering criterion for acquiring and storing, the second and third signals at the second preselected sampling frequency.

4. An apparatus as set forth in claim 1, wherein the controller evaluates the second and the third signals and generates a signal to indicate the completion of the impact hammer phase.

5. An apparatus as set forth in claim 1, wherein the controller produces the respective graph traces of functions of the rod shock force and the sampler penetration depth.

6. An apparatus as set forth in claim 1, wherein the controller produces a summary report of the monitored results including the number of hammer blows impact hammer time, hammer efficiency, and the corresponding sampler penetration depth.

7. An apparatus of claim 1, wherein controller monitors, acquires and processes the first, second and third signals and produces said graph traces in real time during the sampler inserting process, the hammer impact and the sampler penetration process and/or the sampler retrieval process.

8. An apparatus as set forth in claim 1, wherein the tip depth transducer comprises:

first, second and third wheels mounted on a casing for a movable vertical shaft;

the first, second and third wheels capable of rotation about their respective axes;

at least one spring for urging the first wheel against the vertical shaft;

a first rotational sensor operably connected to the vertical shaft for measuring rotation of said first wheel caused by upward or downward movement of the vertical shaft; and the first rotational sensor for the first electrical signal.

9. An apparatus as set forth in claim 8, wherein said first, second and third wheels are vertically and are firmly placed above the casing and surround the vertical shaft at a spacing of 120° an horizontal plane.

10. An apparatus as set forth in claim 8, wherein said first wheel carrying the first rotational sensor for outputting the first electrical signal as a function of the passing length.

11. An apparatus for use with a penetration assembly for hammering a sampler into ground in a drill hole or bore hole, the penetration assembly having; a sampler with a coupler at one end for connecting with a rod; a number of the rods, each end of the rod having a coupler for coupling the rods together in series; an impact hammer apparatus that can be connected or disconnected to the top end of a number of coupled rods in series and can drop the hammer to impact the top end from a constant height;

a lifting device either for lifting a rod for coupling, decoupling, inserting and retrieving or for lifting the hammer to drop for hitting the top end of the coupled rods whose bottom end having the sampler repetitively; the apparatus comprising: a tip depth transducer that outputs a first electrical signal that is a function of the total length of the sampler and rods coupled together in series passing through itself at a fixed reference point on the top of a drill hole;

a shock force transducer that outputs a second electrical signal that is a function of the stock force in the rod and along the rod axial direction;

a shock penetration transducer that outputs a third electrical signal that is a function of the penetration depth of the sampler due to a blow from an impact hammer dropped from a constant height; and a controller that receives and monitors the first, second and third signals, and that produces respective graph traces of functions of the sampler tip position, the rod shock force, and the sampler shock penetration depth, wherein the shock penetration transducer comprises:

a rigid right triangle metal frame having four pulleys attached thereto, one of its two right angle legs firmly mounted onto a horizontal beam fixed on the ground to erect the second right angle leg vertically;

a metal wire loop;

a gear box;

a second rotation sensor;

a rack fixed on the hypotenuse of the right triangle steel frame for the gear to rotate regularly and the gear box to move accordingly;

two guide rods fixed on the hypotenuse of the right triangle steel frame to guide the gear box to move on the rack stably; and a bearing arm;

wherein the metal wire loop that rests and moves smoothly on the four pulleys of the right angle steel frame, and ties the gear box in series above and parallel to the rack, that pulls the gear box to rotate and move on the rack along the direction of the two guide rods.

12. An apparatus as set forth in claim 11, wherein the second rotation sensor connects the axis of a gear in the gear box and communicates the rotation of the gear on the rack to output the third electrical signal that is a function of the position of the gear box on the rack.

* * * * *